United States Patent [19]

Stampe

[11] 4,066,213

[45] Jan. 3, 1978

[54] FUEL INJECTION NOZZLE ASSEMBLY

[75] Inventor: Richard Herbert Stampe, Dike, Iowa

[73] Assignee: Deere & Company, Moline, Ill.

[21] Appl. No.: 677,779

[22] Filed: Apr. 16, 1976

[51] Int. Cl.[2] ..... B05B 1/30

[52] U.S. Cl. ..... 239/533.3; 123/32 JV; 239/600

[58] Field of Search ..... 123/32 JV; 239/533.1–533.15, 140, 600; 285/356, 393

[56] References Cited

U.S. PATENT DOCUMENTS

| | | | |
|---|---|---|---|
| 2,897,800 | 8/1959 | Haas | 123/32 JV |
| 3,764,076 | 10/1973 | Eblen | 239/533.6 |
| 3,908,911 | 9/1975 | Hofmann et al. | 239/533.3 |

FOREIGN PATENT DOCUMENTS

| | | | |
|---|---|---|---|
| 2,402,534 | 10/1974 | Germany | 123/32 JV |

*Primary Examiner*—Martin P. Schwadron
*Assistant Examiner*—Richard Gerard

[57] ABSTRACT

A fuel injection nozzle assembly for internal combustion engines includes a nozzle holder encircled by a hollow screw for fastening the nozzle assembly to the cylinder head of the engine. The nozzle holder further includes an annular groove containing a snap ring device. Abutting the snap ring device is a retaining washer and disposed between the retaining washer and the hollow screw is a plurality of conical snap rings acting to urge the nozzle holder into the cylinder head when the hollow screw is tightened to fasten the nozzle assembly to the cylinder head.

4 Claims, 1 Drawing Figure

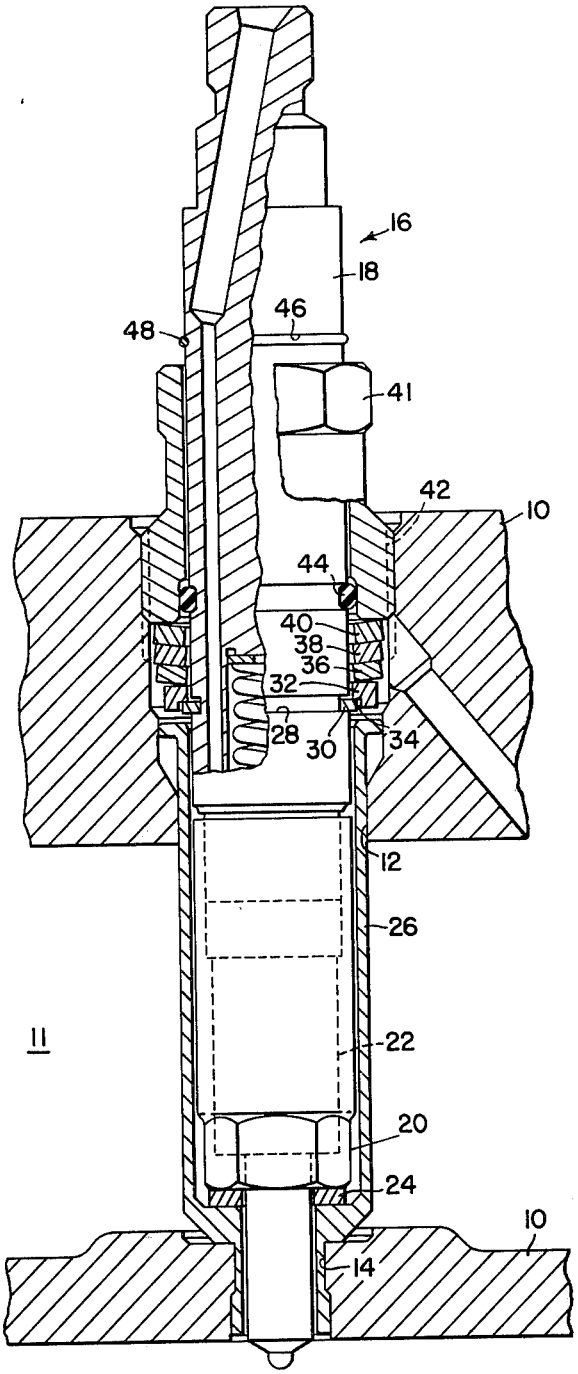
16
18
46
48
41
42
10
44
40
38
36
32
28
30
34
12
26
11
22
20
24
10
14

FUEL INJECTION NOZZLE ASSEMBLY

BACKGROUND OF THE INVENTION

The present invention relates generally to fuel injection nozzle assemblies for internal combustion engines, and more particularly to means for holding the fuel injection nozzle assembly in position in the engine.

A fuel injection nozzle assembly is generally mounted on the cylinder head of a diesel engine with a sealing washer disposed between the sealing face of the nozzle assemblies and a countersunk opening in the cylinder head. In the past, the nozzle assembly was held in position by an external clamp loaded by a long bolt screwed into the head which pressed on the top of the nozzle assembly as shown in the U.S. Pat. No. 3,038,456 granted to A. Dreisin.

More recently, nozzle assemblies have been built having integral apertured flanges held in place by studs secured to the engine and clamped in place by springs disposed between the bolt end of the studs and the apertured flange as shown in the Great Britain Pat. 1,386,835 granted to Smith et al.

The previous holding means have been unsatisfactory in that they have been relatively complex in requiring a large number of pieces and have been difficult to install. Further, the holding means took up a large amount of space which increased the space envelope of the engines to which they have been mounted.

The ideal situation calls for axial loading of the nozzle holder so as to provide uniform loading to prevent leaks as the sealing washer settles. It is also desirable to accomplish this in a single integral package which may be merely inserted in the cylinder head and tightened down with one screw.

SUMMARY OF THE INVENTION

The present invention provides a fuel injection nozzle assembly which has few parts, is easy to assemble, and is effective to prevent leaks due to sealing washer settling.

In accordance with the present invention, there is provided a plurality of conical springs disposed between a hollow screw for fastening the nozzle assembly to the cylinder head and a snap ring and retaining washer combination mounted to the nozzle holder. Tightening the hollow screw loads the springs to urge the nozzle assembly against the sealing washer.

The above and additional advantages of the present invention will become apparent to those skilled in the art from a consideration of the following detailed description of the preferred embodiment when taken in conjunction with the accompanying drawwings.

BRIEF DESCRIPTION OF THE DRAWING

The drawing shows in partial cross section a fuel injection nozzle assembly including the present invention.

DESCRIPTION OF THE PREFERRED EMBODIMENT

Referring now to the drawing, therein is shown a cylinder head 10 provided with a coolant passage 11 and having provided therein an opening 12 and a coaxial countersunk opening 14 into which a fuel injection nozzle assembly 16 is inserted.

The fuel injection nozzle assembly consists of a nozzle holder 18 which includes a nozzle retaining nut 20 to hold a nozzle 22 in place. A conventional sealing washer 24 encircles the nozzle 22 and is inserted between the nozzle retaining nut 20 and a nozzle sleeve 26.

The nozzle holder 18 contains an annular groove 28 into which a conventional snap ring 30 is inserted. A retaining washer 32 having a retaining shoulder 34 abuts and encircles the snap ring 30 so as to prevent it from opening.

Three conventional conical springs 36, 38 and 40 are positioned successively away from the retaining washer 32 and preferably positioned so as to have the smaller diameter of the conical spring 36 abutting the retaining washer 32.

A gland nut or hollow screw 41 encircles the nozzle holder 18 and includes threads 42 for threading into the cylinder head 10 such that a portion of the hollow screw 41 will be brought into abutting relationship with the larger diameter of the conical spring 40. The hollow screw 41 includes a sealing ring 44.

The nozzle holder 18 further includes an annular groove 46 into which a retaining ring 48 is inserted so as to retain the hollow screw 41 around the nozzle holder 18 before the fuel injection nozzle assembly 16 is secured in the cylinder head 10.

The installation of the fuel injection nozzle assembly 16 begins with the nozzle sleeve 26 being inserted into the cylinder head 10 so as the bridge the coolant passage 11. Next, the sealing washer 24 is placed around the tip of the nozzle 22 and the fuel injection nozzle assembly 16 inserted into the nozzle sleeve 26. The threads 42 of the hollow screw 41 are then engaged with the cylinder head 10 and turned until the hollow screw 41 reaches a predetermined position which applies a predetermined pre-load on the conical springs 36, 38, and 40. The pre-load acting through the retaining washer 32 and the snap ring 30 acts to force the nozzle holder 18 to compress the sealing washer 24 into a sealing position between the nozzle retaining nut 20 and the nozzle sleeve 26. Any settling of the sealing washer 24 is taken up by expansion of the conical springs 36, 38, and 40.

While the invention has been described in conjunction with a specific embodiment, it is to be understood that many alternatives, modifications, and variations will be apparent to those skilled in the art in light of the aforegoing description. Accordingly, it is intended to embrace all such alternatives, modifications, and variations which fall within the spirit and scope of the appended claims.

I claim:

1. In a fuel injection nozzle assembly for fastening a fuel injection nozzle to a cylinder head of an internal combustion engine, said assembly having a nozzle holder for holding the nozzle and a hollow screw encircling and slidable on the nozzle holder for fastening the nozzle assembly to the cylinder head, the improvement comprising: the nozzle holder having an annular groove provided therein proximate the nozzle between the hollow screw and the nozzle; a snap ring device partially and radially engaging the annular groove; an annular retaining washer disposed between the hollow screw and the snap ring device partially abutting and radially encircling the snap ring device; and annular conical spring means encircling the nozzle holder disposed between the hollow screw and the retaining washer.

2. The improvement as claimed in claim 1 wherein the nozzle holder has a second annular groove provided therein spaced from the first-mentioned annular groove and remote from the nozzle, and a retaining ring device partially and radially engaging the second annular groove to retain the hollow screw between the first-mentioned and second grooves.

3. In a fuel injection nozzle assembly which is fastened to a cylinder head of an internal combustion engine having a nozzle at one end, a nozzle holder for holding the nozzle, a sleeve encircling the nozzle holder, and a hollow screw encircling and movable on the nozzle holder for fastening the nozzle assembly to the cylinder head, the improvement comprising: the nozzle holder having an annular groove provided therein between the hollow screw and the nozzle; a snap ring device partially and radially engaging the annular groove; an annular retaining means positioned between the hollow screw and the snap ring device partially and radially engaging the snap ring device; annular-conical spring means interposed between the hollow screw and the annular retaining washer urging the nozzle holder and the sleeve into the cylinder head.

4. The improvement as claimed in claim 3 wherein the nozzle holder includes a second annular groove provided therein proximate the hollow screw and opposite the first-mentioned annular groove, and a retaining ring device partially and radially engaging the second annular groove to retain the hollow screw between the snap and retaining ring devices.

* * * * *